United States Patent [19]

Woodhall et al.

[11] Patent Number: 4,887,330

[45] Date of Patent: Dec. 19, 1989

[54] WASHER ATTACHMENT FOR A SUCTION CLEANER

[75] Inventors: Michael B. Woodhall, Berkshire; Brian Gough, Middlesex; Russell G. Wilcox, Berkshire, all of England

[73] Assignee: Shop-Vac Corporation, Williamsport, Pa.

[21] Appl. No.: 287,905

[22] Filed: Dec. 21, 1988

[51] Int. Cl.[4] ..... A47L 7/00

[52] U.S. Cl. ..... 15/322; 15/328

[58] Field of Search ..... 15/321, 322, 328

[56] References Cited

U.S. PATENT DOCUMENTS

| | | | |
|---|---|---|---|
| 2,617,138 | 11/1952 | Brown et al. | 15/321 |
| 3,332,101 | 7/1967 | Leinfelt et al. | 15/321 |
| 3,616,482 | 11/1971 | Brycki | 15/322 X |
| 3,964,925 | 6/1976 | Burgoon | 15/322 X |
| 4,156,952 | 6/1979 | Lynch | 15/321 X |
| 4,307,484 | 12/1981 | Williams | 15/322 X |
| 4,329,756 | 5/1982 | Chicoine et al. | 15/322 X |

*Primary Examiner*—Chris K. Moore

*Attorney, Agent, or Firm*—Ostrolenk, Faber, Berg & Soffen

[57] ABSTRACT

An attachment for the intake hose of a suction cleaner for dispensing liquid to the surface to be suctioned, near the intake to the suction nozzle. A liquid supply tank is supported near the suction nozzle. A valve dispenses the liquid. In one embodiment, a surface engaging brush or roller communicates with the valve. When the surface engaging element engages the surface, it opens the valve to dispense liquid from the tank to a liquid dispensing bar. A second embodiment uses a float valve which normally closes the communication between the inlet to the valve and the outlet from the valve to the dispenser bar. An additional conduit communicates with the nozzle to supply suction to the float valve, and when the suction inlet to the suction nozzle is partially obstructed, e.g. against the surface being suctioned, this increases the vacuum above the suction nozzle. The suction communicates through the additional conduit to the float valve to open the communication from the valve inlet to the dispenser bar. A third embodiment uses a pinch valve. When the valve is open, liquid flows downward over shelves in a progressively wider pattern until the liquid reaches the surface to be cleaned. The valve is normally opened when the irrigator rests on the surface to be cleaned. However, the pinch valve can be locked in a closed position by a slide switch.

25 Claims, 10 Drawing Sheets

FIG. 5.
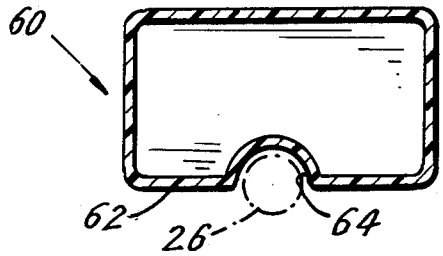
FIG. 6.
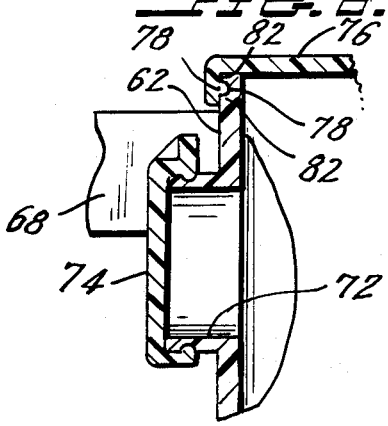
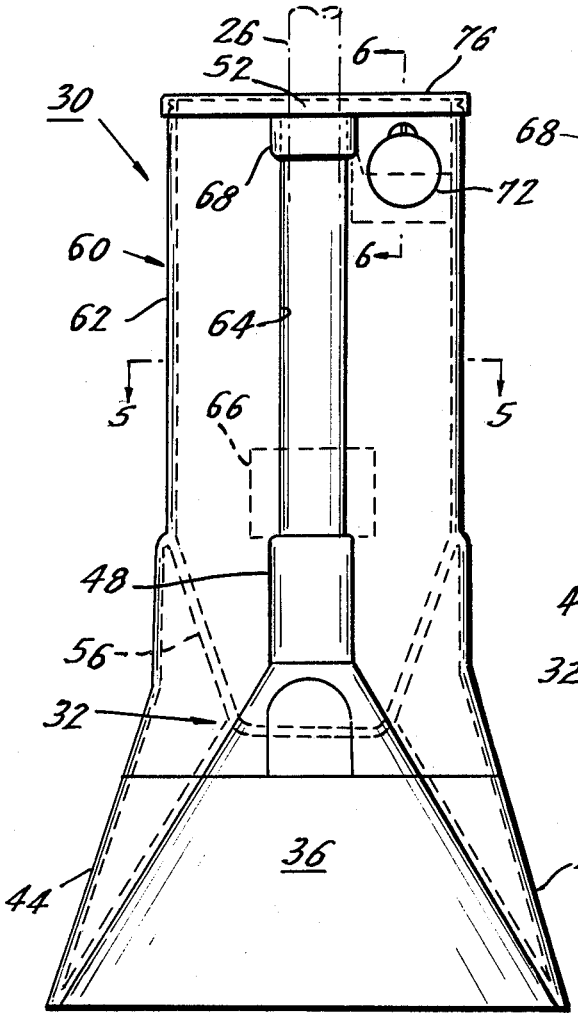
FIG. 3.
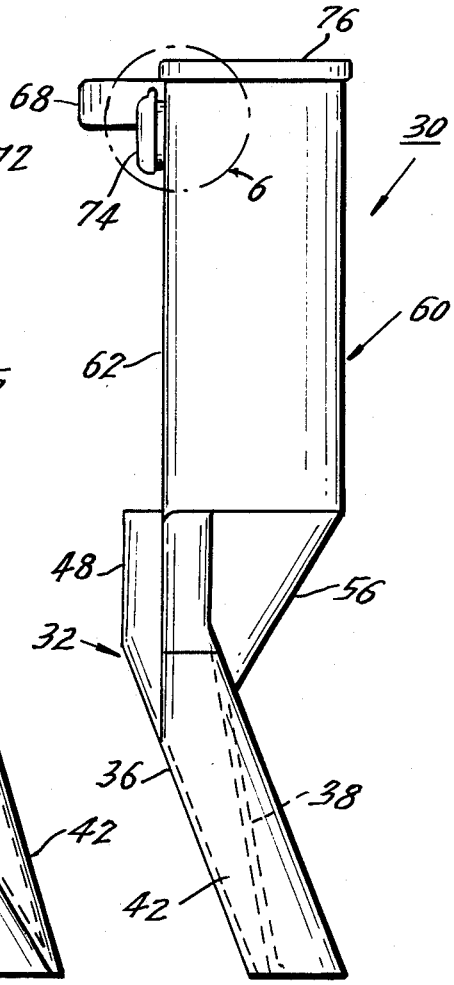
FIG. 4.

FIG. 19.
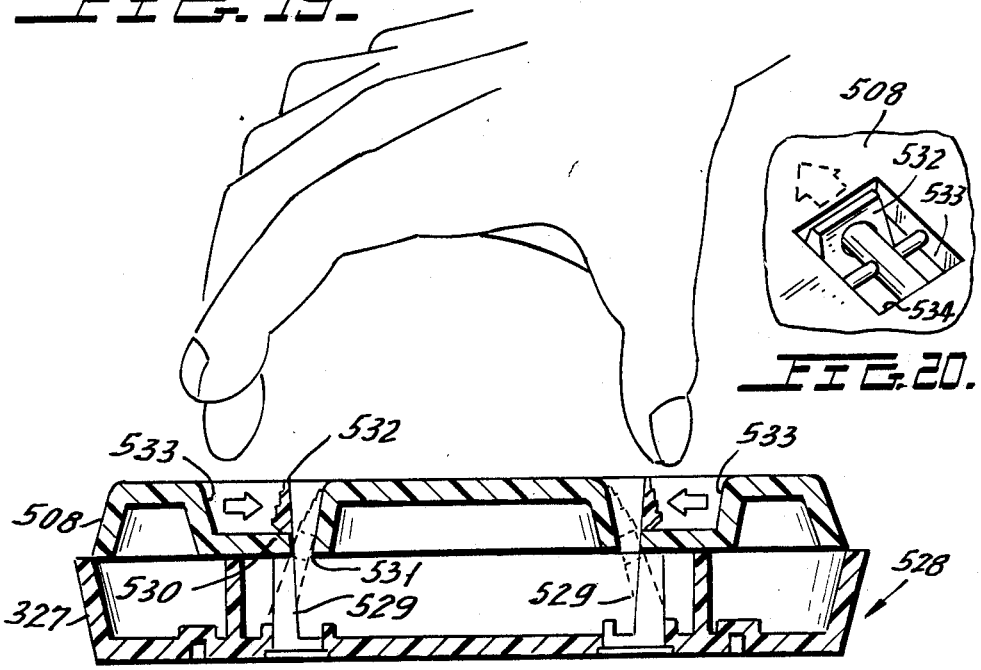
FIG. 20.
FIG. 21.
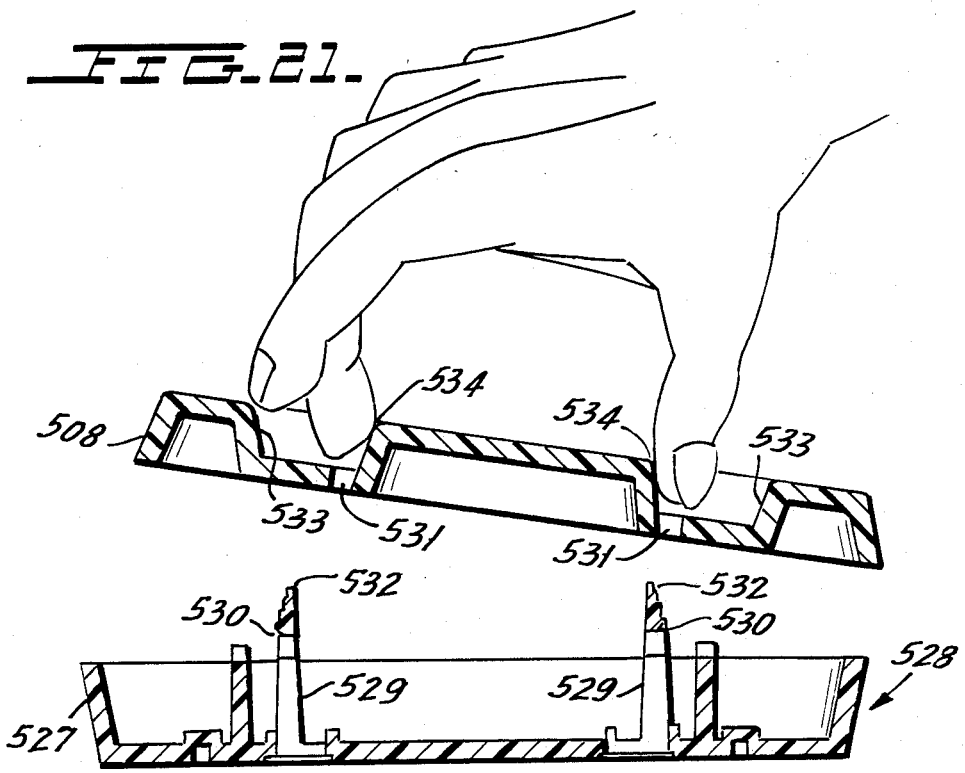

WASHER ATTACHMENT FOR A SUCTION CLEANER

BACKGROUND OF THE INVENTION

The present invention concerns an attachment for washing a surface or a carpet, for being attached to the intake wand of a suction cleaner and for also defining the intake nozzle of the suction cleaner. In particular, the washing attachment includes means for storing an appropriate washing liquid, for dispensing that liquid to the surface to be cleaned in the vicinity of the pickup nozzle and for picking up the liquid and any dirt through the intake nozzle.

Some suction cleaners or vacuum cleaners are adapted for picking up wet materials and liquid. Those typically include a liquid and dirt collection tank, an intake suction hose for suctioning liquid from a surface or carpet and for transmitting it to the collection tank, and a suction motor communicating into the suction hose for suctioning material into and through the intake hose into the tank.

Because such a suction cleaner has the capability of collecting liquid from a surface, a natural development for such a suction cleaner was to deliver cleaning liquid to the surface to be cleaned and to thereafter suction the cleaning liquid from the surface after the liquid washed the surface or dissolved or lifted off some of the dirt. A floor or carpet can be more easily cleaned when water or detergent is delivered to it, is spread in an area to be cleaned and is then suctioned off the surface. The suctioning aids in drying the surface and taking away the dirt.

Some suction cleaners were designed as self-contained liquid dispensing and collecting suction cleaners. Other liquid dispensers and collectors have been developed as attachments to the intake hose or wand of a standard wet/dry pickup suction cleaner. The invention concerns an attachment. The liquid may be supplied to the attachment from an external source through a hose or tube or it may be carried on the cleaning attachment in a liquid dispensing tank. Means are needed for dispensing the liquid to the surface to be cleaned when the liquid is needed.

In some known suction cleaner attachments, liquid dispensed is controlled by a manually-operable trigger which opens the appropriate dispensing nozzles or other means for delivering liquid from the liquid supply. In addition, when liquid is fed from these suction cleaner attachments, sometimes it is pumped out periodically or sometimes continuously, which in any event requires a complicated pump mechanism. Further, this often requires manual activation of an automatic pump or manual operation of a manual pump by the operator of the suction cleaner, which not only requires a more complicated attachment, which is more expensive to fabricate, but also requires more operative steps and greater difficulty for the operator.

In other known attachments, once the attachment is placed on the suction cleaner and the suction cleaner is operated, the liquid drips continuously through a metering outlet nozzle of the liquid supply container no matter whether the suction cleaner is suctioning a surface. In this case, there is little useful control over the dispensing of the liquid, that is, until the attachment is removed from the suction cleaner.

Further, it is useful to dispense the liquid over virtually the entire width of the suction inlet to the intake nozzle, so that the value of dispensing the washing liquid is realized over the full width of the nozzle and is not concentrated toward the center or wherever the nozzle for spraying or dispensing is located.

Prior art does not disclose a valve for dispensing wash liquid from the tank, which valve is activated by moving the suction inlet opening to the surface to be suctioned for partially occluding that opening nor any means for activating that valve when the inlet opening is brought to the surface.

For example, U.S. Pat. No. 2,585,186 discloses a vacuum cleaning device with a shutter that moves in response to wheels contacting the floor. But, this is not concerned with dispensing of liquid from a tank.

Further, suction operated liquid dispensing valves for dispensing liquid upon suction being applied to a work surface are known in the art. See, for example, British Pat. No. 1,123,052 and U.S. Pat. Nos. 3,616,482 and 4,723,337. The latter patent discloses floats. But the floats are not part of a suction responsive liquid dispensing valve.

SUMMARY OF THE INVENTION

Accordingly, it is the primary object of the present invention to provide an attachment for the intake wand of a suction or vacuum cleaner which enables dispensing and subsequent suctioning of a cleaning liquid.

It is another object of the invention to provide such an attachment which does not require separate steps by the user to operate the attachment to dispense liquid, but rather where the dispensing is essentially automatically accomplished.

Another object of the invention is to provide such an attachment which is simple and comprises a minimal number of parts.

A further object of the invention is to provide such an attachment which dispenses liquid over a wide expanse, particularly substantially the width of the intake nozzle.

Another object of the invention is to provide such an attachment which dispenses liquid on demand, although no special manual step is required by the operator to dispense the liquid.

The washer attachment of the present invention is intended to be attached to and to serve as an extension of the intake hose or suction hose of a suction or vacuum cleaner. It is removably attachable to that hose so that its use is optional. The attachment is a self-contained combination of an intake nozzle for suctioning wet and dry material off a surface, a tank, preferably user refillable, for the liquid to be dispensed and means for automatically dispensing liquid from the tank to the surface near the nozzle without the operator having to separately operate the automatic means to dispense the liquid. The intake nozzle itself is conventional, being short front to back, the normal directions of movement of the attachment, and relatively quite wide laterally, side-to-side, producing a wide, but short in length suction inlet. A plenum of the nozzle follows the suction opening and gradually narrows in width until it meets and is joined to the intake hose to the suction cleaner.

A tank for dispensable liquid is mechanically secured on the intake nozzle so that they form a single structural assembly, although the interior of the tank is separated from the interiors of the nozzle and the intake hose, particularly in the first embodiment.

The liquid in the tank is dispensed through an openable valve which is normally shut against leakage. In the first embodiment of the invention, the means for opening the valve is associated with a surface engaging means near the suction inlet opening of the intake nozzle, so that when the inlet opening is placed against the surface or carpet, the surface engaging means contacts the surface, which moves the surface engaging means to, in turn, open the valve and dispense the liquid. In the preferred first embodiment, the surface engaging means comprises a brush or roller which engages the surface and comprises an arm projecting from the axis of the brush or roller into engagement with the shiftable dispensing valve which is normally closed but which is opened to the dispensing condition by the motion of the surface engaging means.

To facilitate distribution of the dispensed liquid substantially over the width of the inlet opening of the intake nozzle, the dispensing valve delivers the liquid to liquid dispensing means comprising an elongate, hollow, liquid dispensing bar, which extends along the width of the intake nozzle just behind that nozzle. The hollow bar has a plurality of outlets along its length, so that liquid is dispensed through the outlets across the width of the intake nozzle just behind the nozzle. When the surface engaging means is raised off the surface, e.g. by lifting the entire attachment off the surface or by tipping the attachment so that the surface engaging means is moved out of contact with the surface, the valve is permitted to reclose and liquid dispensing is terminated.

The residue of liquid already dispensed through the valve which is in the dispensing bar either will drain out of the bar in a short time or appropriate means for effecting immediate cutoff of the flow are used, such as a pinch off unit on a hose leading to the hollow bar.

A second embodiment of the attachment uses an alternate technique for controlling the dispensing of the liquid, but in other respects is the same as the first embodiment. In the second embodiment, the liquid dispensing valve is normally closed, but includes means which open the valve when the suction cleaner is suctioning and a vacuum above a particular level is drawn in the intake nozzle. Such elevated vacuum level occurs when the suction cleaner fan is operating and the intake nozzle suction inlet opening is against the surface being suctioned. The vacuum level is above the level experienced during suction with the suction cleaning fan operating while the intake nozzle inlet opening is off the surface, which provides no obstacle to intake of air through the inlet opening.

In the second embodiment, the dispensing valve is a float valve that is exposed to the liquid in the tank and is normally closed because the liquid in the tank floats the floatable valve element to the valve closed position. The float valve communicates with the intake nozzle and senses the level of vacuum there. The vacuum in the intake nozzle communicates with the floatable valve element through an appropriate connection, and the resulting suction draws the floatable valve element toward the valve opened position against the bias toward valve closure provided by the liquid on which the floatable valve element is floating. When the vacuum level is great enough, the valve element is moved sufficiently to open the valve to permit dispensing of liquid from the tank and into the above-described dispensing means, such as the dispensing bar of the first embodiment. When the vacuum in the intake nozzle is reduced either by raising the suction inlet opening of the intake nozzle off the surface being suctioned or by turning off the suction fan motor, the suction draw of the vacuum upon the floatable valve element is reduced and the floatable valve element moves to the position to shut the valve preventing dispensing of further liquid. As in the first embodiment, means are provided for preventing the undesired slight run-on dispensing of liquid from the dispensing bar after the valve has closed but before the dispensing bar has fully emptied.

In the third embodiment, a slide switch is included for locking the valve in a closed nondispensing position and for opening the valve for dispensing. A flexible tube communicates with the tank. The slide valve pinches the tube to prevent liquid from flowing from the tank by gravity. Here, the dispenser bar is replaced by an irrigator that receives liquid from the tank and the attached tube. The irrigator includes an array of openings across the bottom. A gradually widening array of waterfall shelves lead to the outlet openings. In operation, liquid flows by gravity from the tube over the irrigator shelves in a progressively widening pattern, through the outlet openings and onto a surface to be cleaned. The third embodiment of the attachment may be particularly economical to manufacture because it has relatively few parts.

Other objects and features of the present invention will become apparent from the following description of preferred embodiments of the invention considered in conjunction with the accompanying drawings.

BRIEF DESCRIPTION OF THE DRAWINGS

FIG. 3 is a front view of the washer attachment;

FIG. 4 is a side view of the washer attachment;

FIG. 5 is a cross-sectional view along the arrows of FIG. 3;

FIG. 6 is an enlargement of detail 6 of FIG. 4;

FIG. 19 is a cross-sectional view through the line XIX—XIX of FIG. 16;

FIG. 20 is a partial perspective view of a clip of the third embodiment of the washer attachment;

FIG. 21 is a view similar to FIG. 19 but illustrating a disassembly feature of the third embodiment of the washer attachment.

DESCRIPTION OF THE PREFERRED EMBODIMENTS

Figure 1:
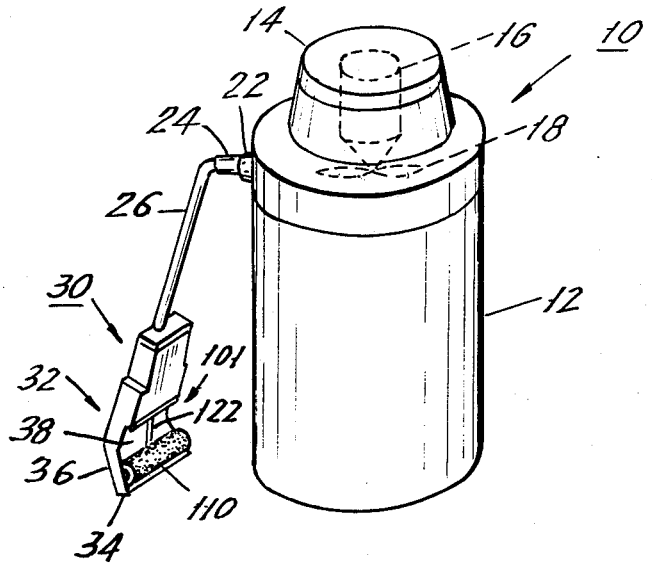
FIG. 1 is a view of a suction cleaner connected to washer attachment according to the invention.
Figure 7:
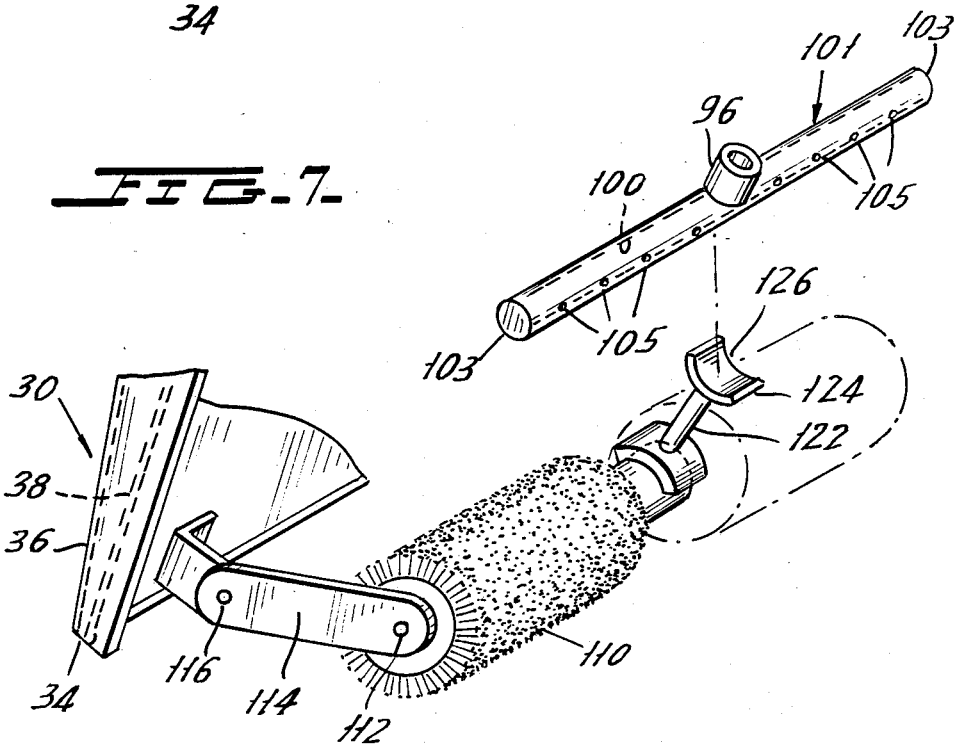
FIG. 7 is a perspective fragmentary view, partially exploded, of the surface engaging means of the invention.

Referring to FIG. 1, all embodiments of the present invention are useful in conjunction with any conventional suction or vacuum cleaner 10 which is adapted for wet/dry pickup and which includes a conventional wet and dry material collecting tank 12, a head 14 in which is contained a conventional blow motor 16 which drives a suction fan 18 for creating suction in the intake nozzle 30, an inlet 22 to the tank (as illustrated) or to the head 14 and leading into the tank and an intake fitting 24 received in the inlet 22. The intake fitting 24 communicates into a wand 26 to be held by the hand of an operator and the attachment of each described embodiment of the invention is adapted to be attached to the wand 26.

Referring to FIGS. 2–7, the attachment 30 includes a relatively standard suction inlet nozzle 32 which comprises an inlet opening 34 which is defined between the front wall 36 and the rear wall 38 of the nozzle 32 and between the lateral walls 42 and 44 thereof. The walls 36, 38, 42 and 44 are placed so that the nozzle is relatively narrow between the front and rear walls 36, 38 in the direction of movement of the nozzle, is relatively wide between the lateral walls 42, 44, and the inlet opening 34 into the nozzle has a narrow enough cross-section that when a vacuum is applied to the nozzle 32, the suction at the inlet opening is sufficient to raise dirt and liquid off the surface to be suctioned through the nozzle inlet opening 34. Above the inlet opening 34, the walls 36, 38 taper gradually apart while the lateral sides of the nozzle taper gradually together until the nozzle 32 merges into the wand attachment fitting 48. The wand attachment fitting 48 extends to and receives at its end 52 the inserted end of the tubular wand 26. By this connection, the suction generated by the fan 18 is transmitted as vacuum in the wand 26 and nozzle 30 and as suction at the nozzle inlet opening 34.

The rear wall 38 of the nozzle extends into and meets with and is integrated with the exterior 56 of a dispensable liquid holding tank 60. For aesthetic reasons, the tank 60 is shown as having a generally rectangular transverse cross-section (FIG. 5). For stability of the unit, the tank is wider than the wand attachment fitting 48, so that the weight of the tank 60 is located nearer to the surface being suctioned. The front wall 62 (See FIG. 2) of the tank 60 has a rounded depression 64 in which the wand 26 is at least partially received. Upstanding from the wall 62 are the wand engaging brackets 66 and 68 which hold the tank 60 securely to the wand and make them a single integrated unit. The brackets 66, 68 permit separation of the wand 26 from the tank 60 when replacement of the tank is needed, and cleaning of the tank is rendered easier.

Figures 2, 8:
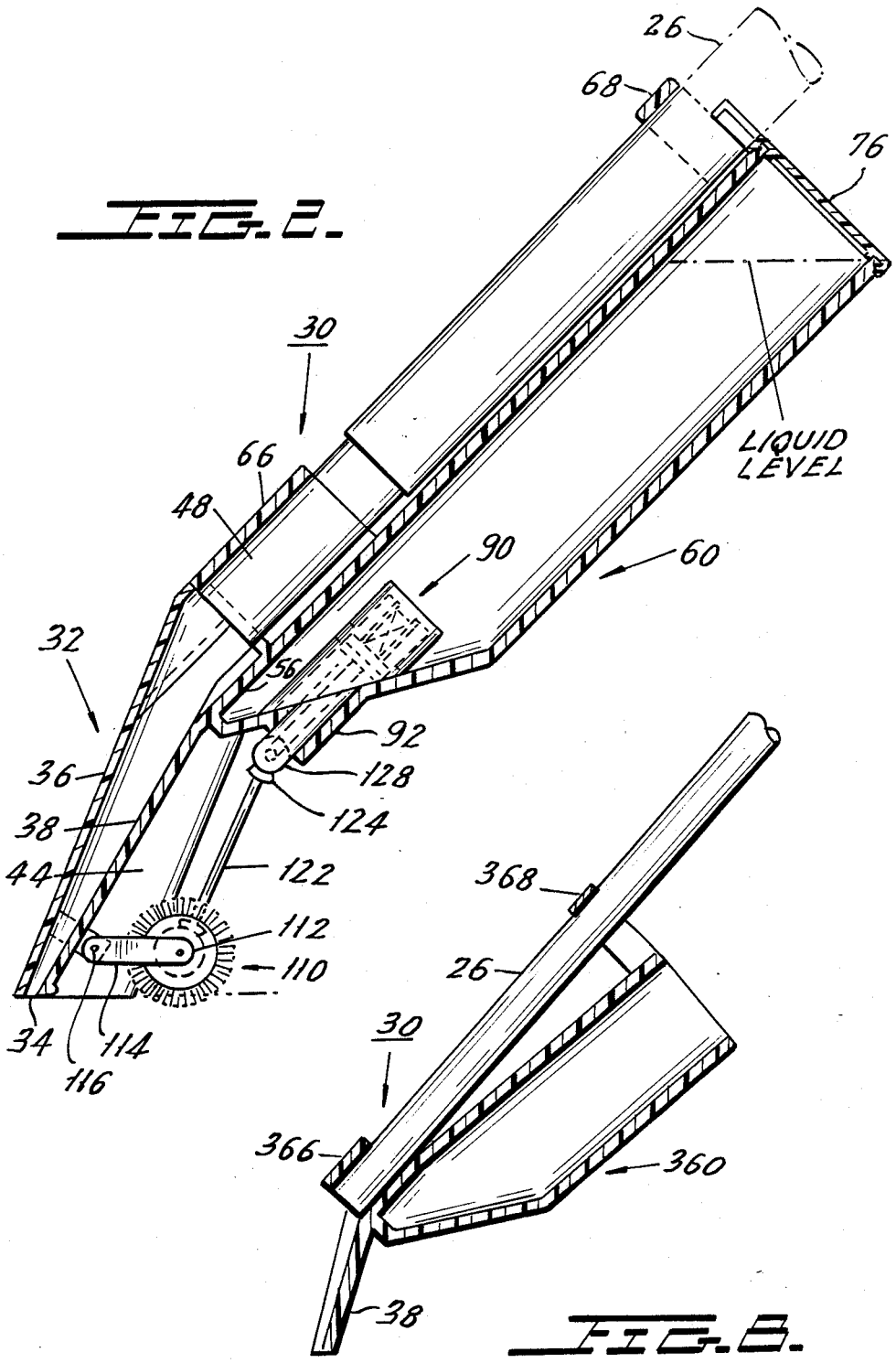
FIG. 2 is a side view in cross-section of a first embodiment of the washer attachment.
FIG. 8 is a side cross-sectional view of a modified washer attachment according to the invention.
Figure 9:
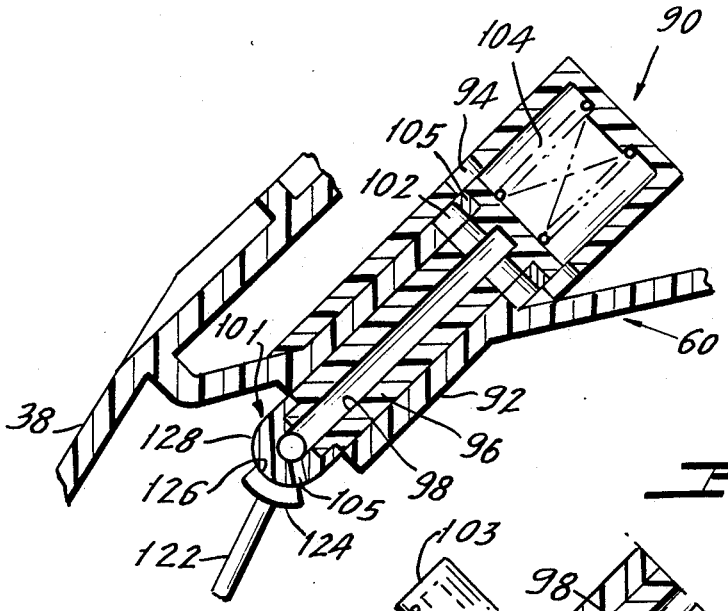
FIG. 9 is a fragmentary side cross-sectional view of the valve for the first embodiment.

FIG. 8 illustrates a slightly different tank 360 without a depression like 64 and taller brackets 366, 368 for holding to the wand 26. The rear wall 38 of the nozzle is integrated into the tank 60.

Referring to FIG. 6, the tank front wall 62 has a filling opening 72 formed in it near the top of the tank which is closed by a removable cap 74, which is a friction fitted or threaded on plug, bung, or the like. The top wall 76 of the tank is double flange sealed over the peripheries of the four side walls of the tank, and is sealed by internal annular flange 78 around the cover and external annular flanges 82 around the side walls of the tank 60. Periodic removal of the cover 76 permits cleaning of the interior of the tank, maintenance on the below described valve and provides an alternate technique for filling the tank. It is contemplated that the tank could be filled from a standard household faucet or tap either through the opening 72 or through the opened tank top resulting from removal of the wall 76.

Referring to FIGS. 2, 7 and 9–11, for dispensing the liquid from the tank, a valve 90 is provided. The housing of the tank 60 includes a fixed sleeve 92 projecting into the tank, which supports a movable valve element. Passing through the sleeve inside the tank is an opening 94 through which liquid can exit the tank 60. The sleeve 92 sealingly receives a longitudinally movable valve element 96 which has an internal liquid channel 98 passing along its length. The liquid channel 98 communicates with an opening 102 through the peripheral wall of the valve element 96. A spring 104 normally urges the valve element 96 outwardly of the tank, and the below described shoe 124 defines the maximum extent to which the valve element 96 may move out of the tank. At this time, the openings 94 and 102 are misaligned to prevent liquid passage, and seal 105 prevents leakage. When the valve element 96 is pushed inwardly into the tank by the surface contact means 110–124 described below, eventually the openings 94 and 102 align, as in FIG. 10, and liquid in the tank exits through the openings 94, 102 into the passage 98 by gravity and the pressure of the weight of the column of liquid in the tank. The openings gradually move into alignment so that initially only a smaller amount of liquid exits through the partially aligned openings. As the valve element 96 moves further into the tank, the openings 94 and 102 move more into alignment, so that more of their cross-sections overlap and more liquid can be dispensed. The shapes of either or both of these openings may be appropriately selected, e.g. one may be triangular, to control the extent of overlap dependent upon the extent to which the valve element 96 is inside the tank.

Figure 11:
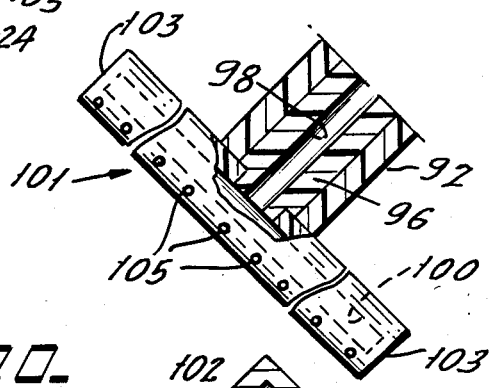
FIG. 11 is a front and partial cross-sectional and fragmentary view of the valve and dispenser for the washer attachment.
Figure 10:
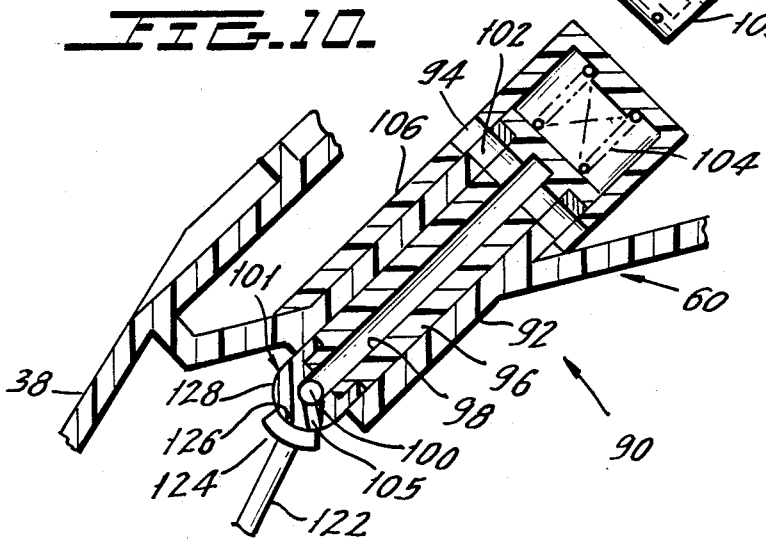
FIG. 10 is the same type of view as FIG. 9, showing the valve in a different operating position.

Referring to FIG. 11, the bottom end of the passage 98 communicates directly into a cross passage 100 which is the interior of a widthwise elongate dispensing bar 101. The bar 101 is simply an opened tube whose ends 103 are closed and which is provided with a plurality of openings 105 along one side thereof leading from the widthwise passage 100 so that liquid in that passage will drip through the openings 105 onto the surface being cleaned. The cross-sections of the openings 105, their frequency and locations, along with the nature of the liquid being dispensed, determine the rate at which liquid exits each of the openings 105 and spreads the liquid across the width of the nozzle to the desired extent.

Referring to FIGS. 2, 7, 9 and 10, to cause dispensing of liquid through the dispensing bar 101, the valve element 96 must be pushed up against the bias of the spring 104 to bring the openings 94, 102 into alignment. For this purpose, there is a surface engaging means comprising a freely rotatable bristle brush 110 that is supported on a rotary axle 112. The freely rotatable brush is particularly useful on carpeting, as its bristles push into the upstanding carpet fibers and not only help keep the carpet fibers upstanding, but brush them and dislodge the dirt. If the attachment 30 is moved forward and back, the carpet is repeatedly wetted, cleaned and rubbed, which improves the cleaning. As an alternative to the brush 110, which is freely rotatable, a stationary brush may be provided so that forward and back movement of the attachment 30 rubs the surface to be cleaned. Any other surface contacting means, such as a bar or roller, may be substituted, since the important function of the brush 110 herein is to open the valve element 96 to dispense liquid.

The ends of the brush axle 112 are connected by support struts 114 to pivot supports 116 on the rear wall 38 of the nozzle. The struts 114 pivot around the pivots 116 as the brush 110 rises and descends. Approximately centrally along the brush, that is centrally widthwise of the attachment 30, a post 122 at its bottom end carries a shoe that rests on the axle 112 of the brush. A direct freely rotatable connection may instead be used. The other top end of the post 122 carries a narrow width shoe 124 whose top side 126 is rounded to normally support the underside 128 of the dispensing bar 101 resting on it. Preferably, the post 122 is generally aligned, widthwise of the attachment, below the valve element 96, so as to not impose any undesired torque against the dispensing bar 101. The spring 104 presses the dispensing bar and the valve element 96 against the shoe 124.

When the suction nozzle inlet opening 34 is placed against the surface to be suctioned, the brush 110 is positioned on the attachment so that it too is so placed against the surface. The brush pushes up on the post 122 which, through the shoe 124, presses up on the valve element 96 which brings the openings 94, 102 into alignment and dispenses liquid from the tank. When the entire attachment 30 is raised off the surface by the wand or the attachment 30 is tipped forward around the front wall 36 of the nozzle, the brush 110 no longer pushes up on the valve element 96 and the spring 104 moves the openings 94, 102 back into misalignment (FIG. 9), cutting off further dispensing of liquid from the tank 60. The operator therefore is able to dispense liquid when desired merely by using the attachment 30 to the wand 26 in the expected manner, that is by putting the suction nozzle inlet opening 34 near the surface to be suctioned. No additional step by the operator is needed to dispense liquid from the tank. The liquid drips onto the surface from openings 105. During normal use of the attachment 30, the nozzle is gradually moved rearwardly, and as the inlet opening 34 passes over the previously wetted surface, the dispensed liquid, any material dissolved in the liquid and any other materials on the surface capable of being suctioned are sucked through the inlet opening 34 eventually moving to the collecting tank of the suction cleaner.

Figures 12, 13, 14:
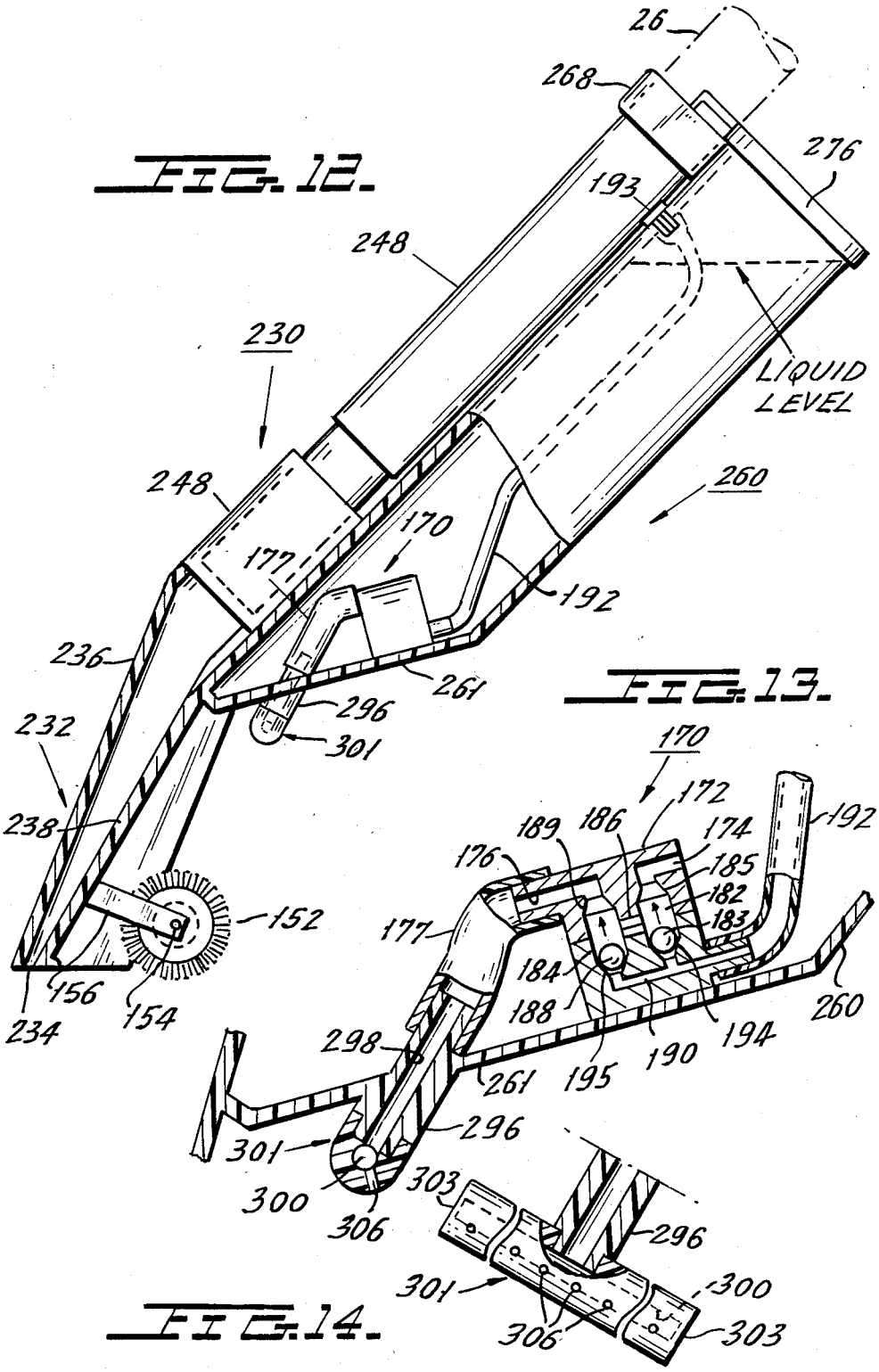
FIG. 12 is a side cross-sectional view of an alternate embodiment of the washer attachment.
FIG. 13 is a fragmentary detail showing the valve for the second embodiment.
FIG. 14 is a fragmentary partially cross-sectional front view of the dispensing means of the second embodiment.

The second embodiment of the attachment, shown in FIGS. 12–14, shares many elements in common with the first embodiment and the shared features are not described again. They are identified by the same reference numerals of the first embodiment, raised by 200. Elements that are different from those in the first embodiment are described herein using reference numerals between 150 and 230.

In the second embodiment, the valve for dispensing liquid is not associated with a surface engaging means, like 110. Therefore, the surface engaging brush 152 is supported by its rotary axle 154 on a stationary, non-pivotable strut 156, which projects non-movably from rear wall 238 of the nozzle 232. As previously, the dispensing of liquid is through the passage 298 in the dispensing element 296, which leads to the transverse passage 300 in the dispensing bar 301.

The dispensing element 296 in this embodiment does not move, contrary to the first embodiment. There is instead a float valve assembly 170 disposed inside the tank 260 at the bottom wall 261 so as to be exposed to the pool of liquid in the tank 260. The valve 170 is a float valve that selectively opens or blocks the flow of liquid from inside the tank 260 into the outlet passage 298.

The float valve 170 includes a valve block 172 with a liquid inlet 174 communicating into the tank 260 and a liquid outlet 176 communicating through conduit 177 into the outlet dispensing passage 298. There are two float valve chambers, 182 associated with the inlet 174 to the valve block and 184 associated with the outlet 176 from the valve block. The valve actually needs only one of the valve chambers 182, 184, but effective and reliable operation uses two of them. Liquid in the tank 260 flows through the inlet 174 into the chamber 182 and floats the float element or ball 183 up through the chamber 182 to engage the seat 185 and close the pathway from the inlet 174 through the cross passage 186 that would lead to the chamber 184 and then through the outlet 176. Liquid in the cross passage 186 would flow into the chamber 184 and float up the float element or ball 188 against the upper seat 189 blocking the outlet 176. Flow through the valve is therefore prohibited.

The chambers 182, 184, at their respective bottom ends opposite from the inlet 174 and outlet 176, communicate through a common passage 190, through a connecting hose 192, through a fitting 193 above the liquid level in the tank into the interior of the wand attachment fitting 248. The vacuum drawn through that fitting is dependent upon the degree of occlusion of the suction inlet opening 234 into the intake nozzle 232. As the opening 234 is blocked more completely, as it would be when it is pressed against the surface to be cleaned, the vacuum in the nozzle 232 and fitting 248 increases. This vacuum is transmitted through the table conduit 192 into the passage 190 and acts upon the presently upraised float elements 183, 188 seated on seats 185, 189. Those float elements are designed so that when the vacuum exceeds a particular level, those elements are sucked down against the normal bias applied to them by the liquid floating them and are drawn against the respective bottom seats 194 and 195. Because this moves the float elements below the cross passage 186, it permits liquid to enter the inlet 174, pass through the chamber 182, through the cross passage 186, into the chamber 184 out the outlet 176, through the conduit 177 and into the dispensing passage 298 in the element 296, for dispensing liquid to the dispensing bar 301. The vacuum in the nozzle 232 or the adapter 248 drops below a preset level when the suction inlet opening 234 is raised off the surface which opens the occluded opening 234, reduces the resistance to suction and thus reduces the vacuum drawn, or else when the suction motor itself is stopped. Then the liquid flowing into the inlet 174 and the chamber 182 causes the float element 183 to rise against seat 185, blocking the inlet 174. The liquid in the valve block in the chamber 184 causes the ball 188 to similarly rise past the cross passage 186 to the seat 189 and cut off the exit flow.

The fitting 193 from conduit 192 is preferably connected into the wand attachment fitting 248 at a height above the level of liquid in the tank 260 during use, so that the liquid which enters the passage 190 and the conduit 192 is not forced out by the pressure head of the liquid in the tank above it or is not sucked out through the conduit 192 by the vacuum in the fitting 248. With the outlet fitting 193 high enough, the vacuum in the fitting 248 is still transmitted to the valve 170. But, the level of that vacuum is not great enough to raise the liquid in the passage 190 and the conduit 192 so that it will leak or drip into the fitting 248.

The third embodiment of the attachment, shown in FIGS. 15–21, shares many elements in common with the first embodiment and the shared features are not described again. They are identified by the same reference numerals of the first embodiment, raised by 400. Elements that are different from those in the first and second embodiments are described herein using reference numerals between 500 and 534.

Thus, in the third embodiment, an attachment 430 is provided for use with a tubular wand 26. The attachment 430 includes a tank 460 which includes a top wall 476, a front wall 462 and an opening 498. The attachment 430 is adapted to be connected to the tubular wand 26 by a first wand engaging bracket 466 and a second wand engaging bracket 468. The brackets 466, 468 are slidable over the tubular wand 26 until a wand attachment fitting 448 is inserted into and attached to the first wand engaging bracket 466. The attachment 430 further includes a nozzle 432 which has two walls 436, 438 and an inlet opening 434. In operation, dispensable liquid from the tank 460 is directed onto a carpet or other surface to be cleaned and then the liquid (along with any dirt) is vacuumed through the inlet opening 434 and up through the tubular wand 26.

In particular, the opening 498 includes a 90° elbow 500 and a coupling portion 501. A first end 502 of a flexible, silicone rubber tube 503 is frictionally coupled to the coupling portion 501. A second end 504 of the tube 503 is coupled to a second coupling portion 505. Thus, liquid can flow by gravity through the opening 498, then through the 90° elbow 500, then through the tube 503, and then into a liquid divider 506. The flexible tube 503 can be pinched closed at a region indicated at 507 to interrupt the gravity flow. Although a flow pinch off is not specifically illustrated in the drawings of the other two embodiments, a corresponding type of pinch off may be disposed on the connection between the tank and the dispenser bar.

The attachment 430 further includes a clear irrigator 508. The irrigator 508 includes a pivot pin 509 which is attached to a divided or bifurcated fulcrum arm 510. The divided fulcrum arm 510 is fixed to the wall 438 of the nozzle 432. Thus, the irrigator 508 can pivot or rotate about the pivot pin 509. The irrigator 508 includes an actuator member 511 for pinching the tube 503 at the region 507. Thus, to interrupt gravity flow from the tank 460 to the divider 506, the actuator member 511 is actuated to pinch the tube 503 between an end 512 of the actuator member 511 and a pinching member 513 which is attached to a lower portion of the wall 438.

A spring 514 biases the irrigator 508 in a counterclockwise direction (as viewed in FIG. 15) by acting upon a spring abutment member 515. This pinches off flow, as described below. However, the irrigator 508 is forced in a clockwise direction when the bottom 516 of the irrigator 508 contacts or is placed against the surface to be cleaned. Thus, when the attachment 430 is operated with the inlet opening 434 placed on the surface to be cleaned, the bottom 516 is biased in a clockwise direction by the surface and therefore the actuator member 511 is biased away from the region 507. When the actuator member 511 is biased away from the region 507, liquid can flow out of the tank 460 by gravity through the tube 503 and to the divider 506. When the attachment 430 is lifted from the surface, the spring 514 acts against the spring abutment member 515 to rotate the irrigator 508 in the counterclockwise direction to pinch the tube 503 between the end 512 of the actuator member 511 and the pinching member 513 to interrupt the flow of liquid.

Figures 15, 15A:
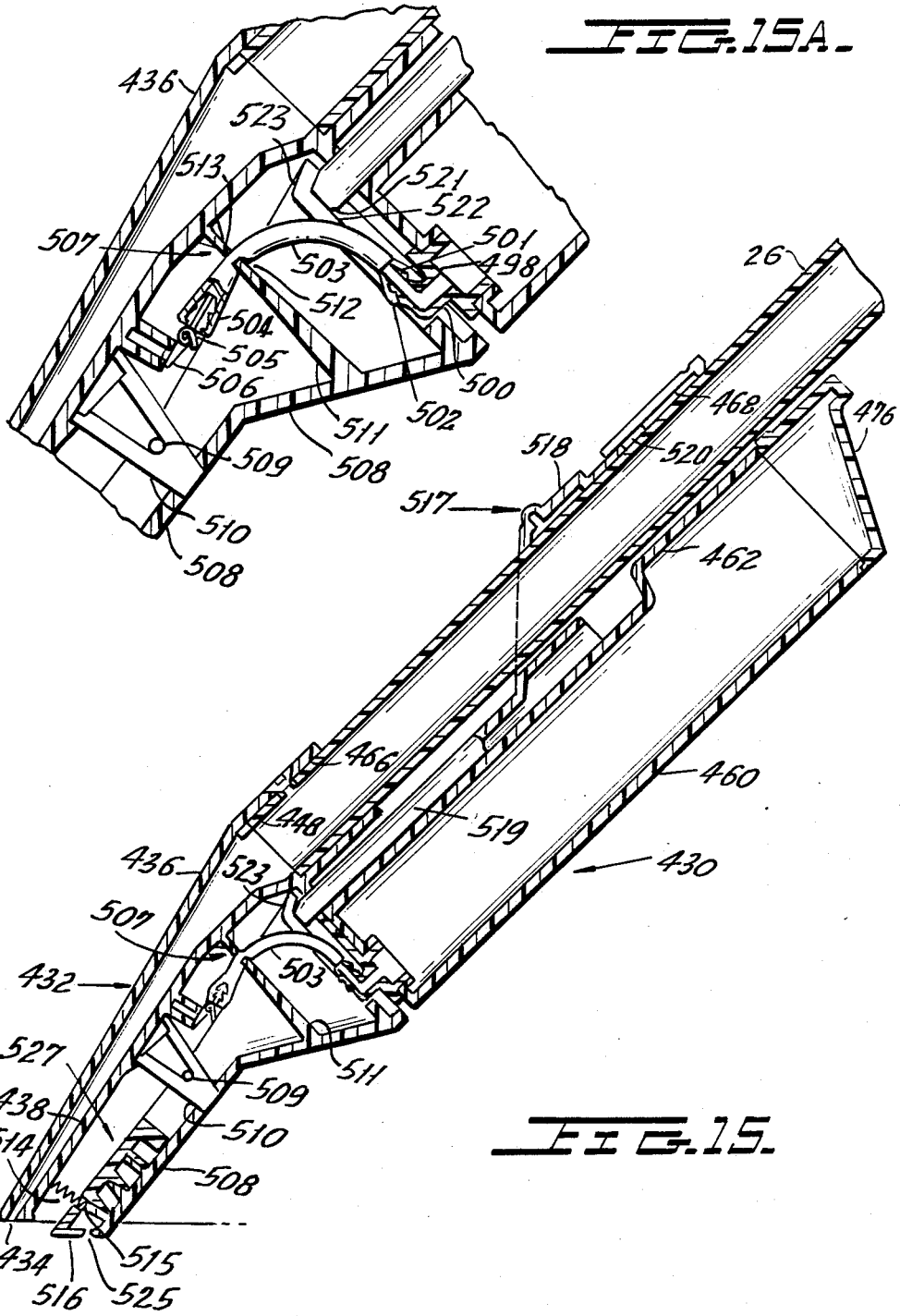
FIGS. 15 and 15A are a side view in cross-section of a third embodiment of the washer attachment, and an enlarged detail thereof.

The attachment 430 includes a molded on/off switch 517 for locking the clear irrigator 508 in the "off" position shown in FIG. 15. In that "off" position, the tube 503 is pinched closed between the actuator member 511 and the pinching member 513. The on/off switch 517 includes a member 518 for surrounding the tubular wand 26 and an elongate member 519 which extends downward within a recessed region of the front wall 462 of the tank 460 and to the irrigator. The switch 517 is thus adapted to both surround the wand 26 and to be located between the tank 460 and the tubular wand 26. The on/off switch 517 is slidable with respect to both the tubular wand 26 and the tank 460. In the "off" position shown in FIG. 15, the on/off switch 517 is disposed downwardly, defining a space 520 between the switch 517 and the second or upper wand engaging bracket 468. At the other lower end of the member 519 of the on/off switch 517 away from the space 520, the on/off switch 517 includes a locking abutment end 521. In the "off" position of FIG. 15, the locking abutment end 521 is directed against a locking surface 522 of the irrigator 508. The locking surface 522 includes a shoulder 523 which in the "off" position is captured against the locking abutment end 521 and is prevented from rotating in a clockwise direction about the pivot pin 509 even when the bottom 516 of the irrigator is resting against the surface to be cleaned. Thus, in the "off" position the flexible tube 503 is always pinched closed, regardless of whether the bottom 516 of the irrigator 508 is resting on a surface.

Figure 16:
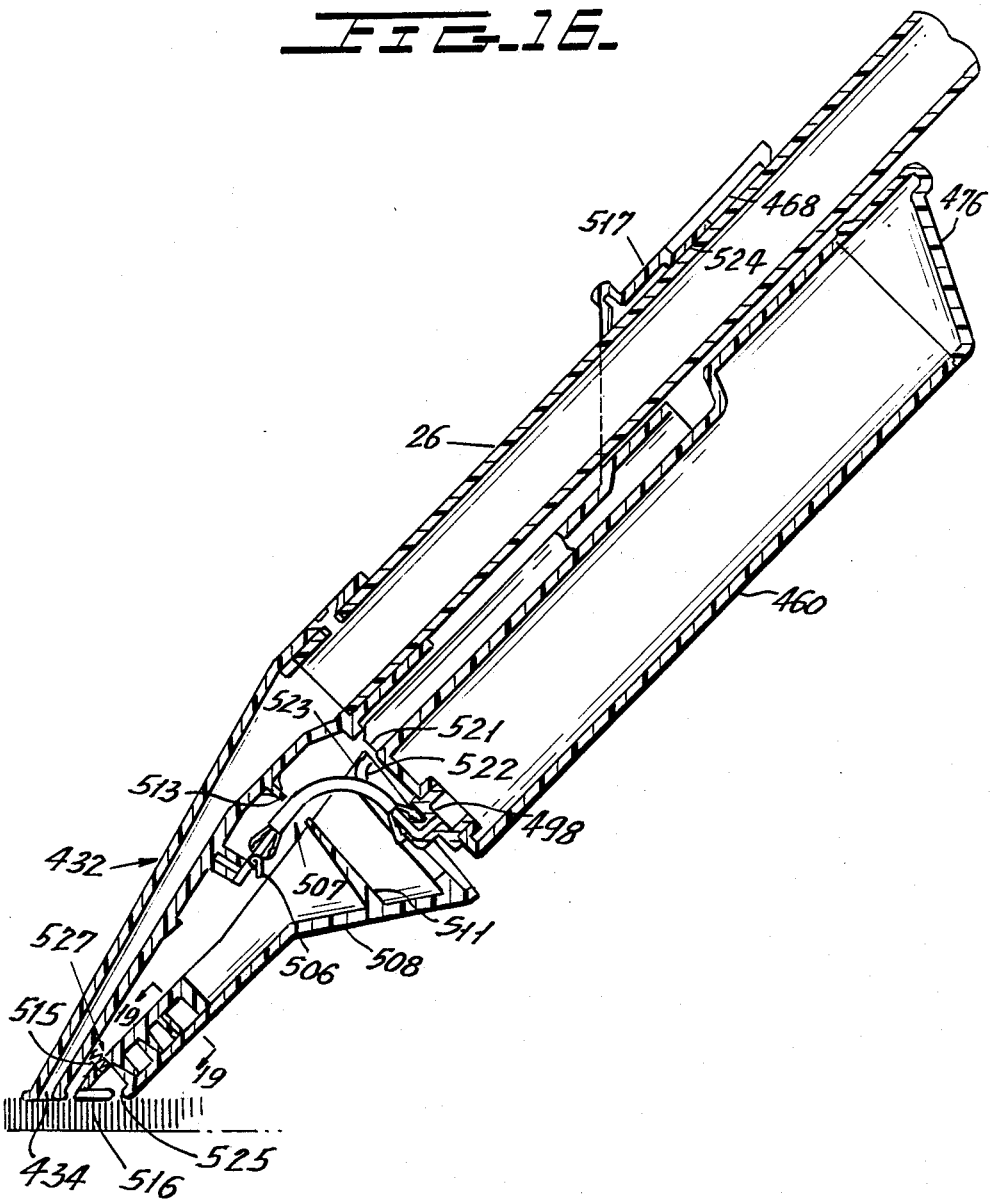
FIG. 16 is a view similar to FIG. 15 but with an on/off switch in a different operating position.

Referring now to FIG. 16, the attachment 430 is shown with the on/off switch 517 in an "on" position, wherein the switch 517 is moved upwardly to close the space 520 shown in FIG. 15. An upper end 524 of the on/off switch 517 contacts the second wand engaging bracket 468. In the "on" position the locking abutment end 521 of member 519 does not contact the locking surface 522 and cannot capture the shoulder 523. Thus, the on/off switch 517 has no influence on the position of the irrigator 508 or on whether or not the tube 503 is pinched at the region 507. When the switch 517 is in the "on" position the tube 503 is either not pinched or is pinched at the region 507 depending upon whether the bottom 516 is respectively resting on or against the surface to be cleaned or not resting against it. When the bottom 516 is resting against the surface, the irrigator 508 is moved clockwise in FIG. 16 against the bias of the spring 514, which moves the actuator member 511 away from the tube 503. Thus, when the attachment 430 is in use with the inlet opening 434 and the bottom 516 resting on a surface, dispensable liquid will flow by gravity from the tank 460 through the opening 498, then through the tube 503, then through the divider 506 and then eventually through openings 525 at the bottom 516 of the irrigator 508. On the other hand, when the attachment 430 is lifted from the surface, the irrigator 508 is biased counterclockwise by the spring 514 acting against the spring abutment member 515 to move the actuator member 511 to pinch the tube 503 between the actuator member 511 on the pivoting irrigator and the stationary pinching member 513.

Figure 17:
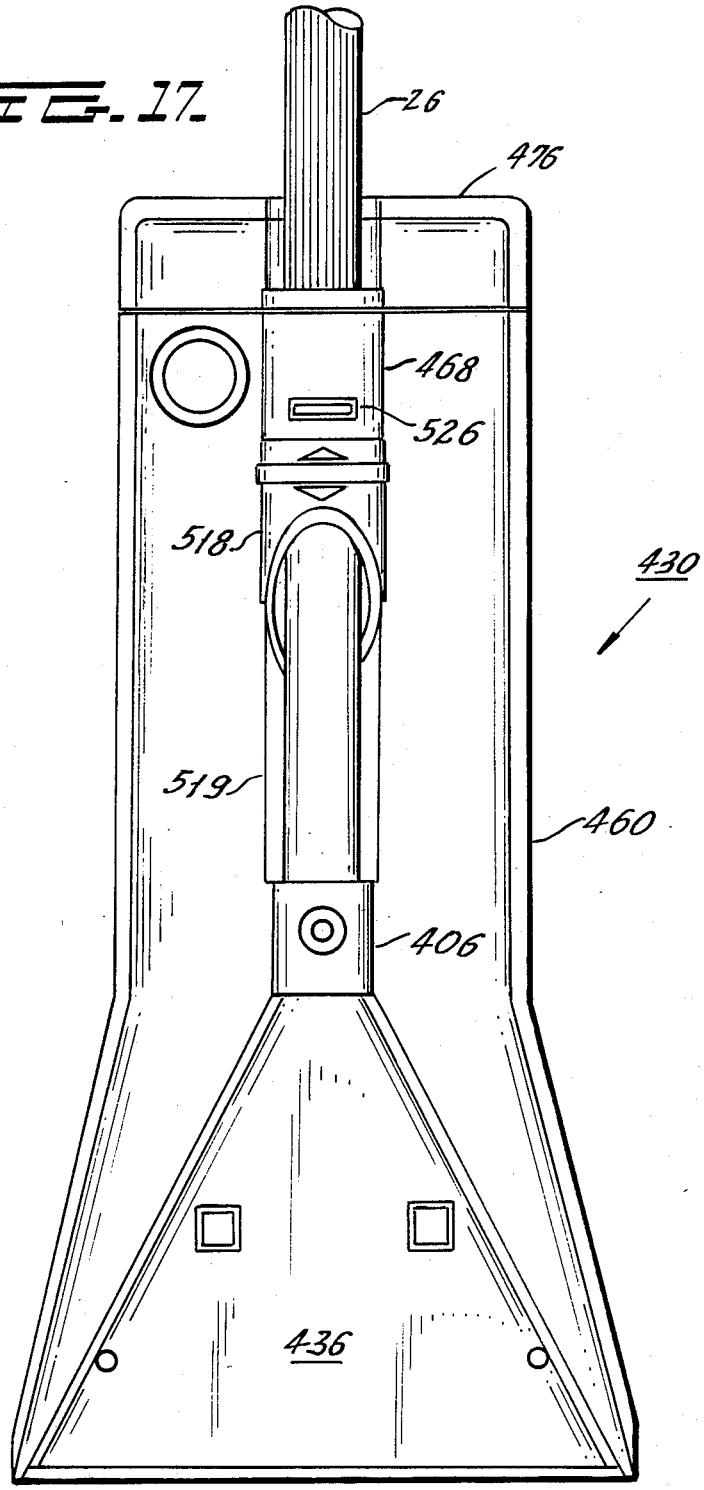
FIG. 17 is a front elevational view of the third embodiment of the washer attachment.

Referring to FIG. 17, the second wand engaging bracket 468 and the switch 517 indicate the position of the switch 517. The second wand engaging bracket 468 includes a window 526 for viewing indication labels located on the switch 517, e.g. green for "on" and red for "off". When the switch 517 is in the "on" position, the green label is aligned beneath the window 526. When the switch 517 is slid to the "off" position, this aligns the red label beneath the window 526.

Figure 18:
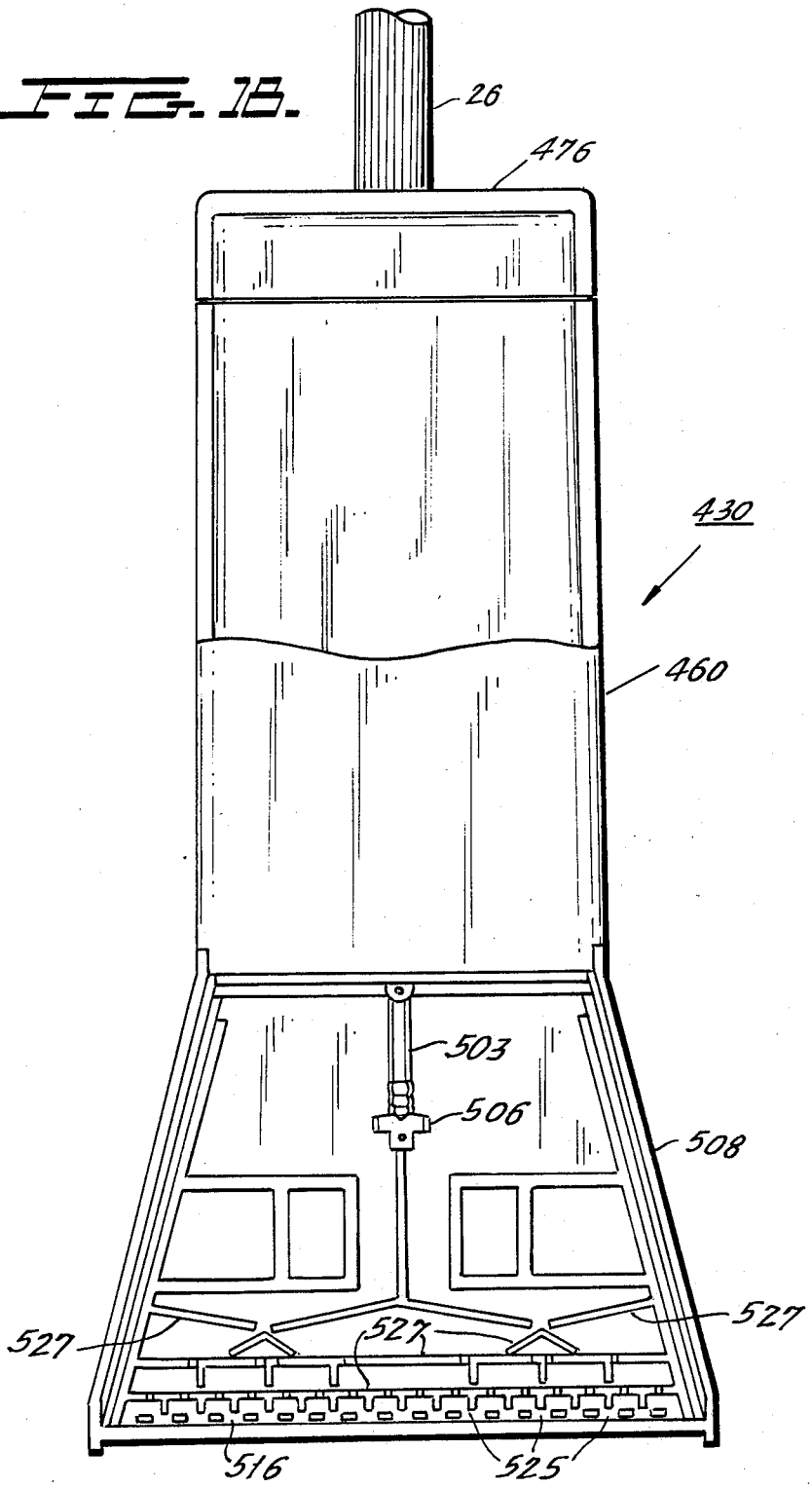
FIG. 18 is a front view of an irrigator of the third embodiment of the washer attachment.

The flow of liquid from the tank 460 to the bottom 516 of the irrigator 508 and then out through the openings 525 is shown in more detail in FIG. 18. The liquid falls under the force of gravity from the divider 506, falls onto the irrigator 508, and cascades over and along waterfall shelves 527. The shelves 527 are formed as a unit with and are held against the irrigator 508 in the pattern shown in FIG. 18. The shelves 527 are designed to regulate and distribute the liquid into a progressively wider pattern as the liquid cascades downward. Thus, the liquid reaching the openings 525 has been controllably spread across the full width of the attachment 430.

As illustrated in FIGS. 19 and 21, the shelves 527 are removable as a unit 528 from the remainder of the irrigator 508. The shelves 527 are normally retained against the remainder of the irrigator 508 by resilient pins 529. The pins 529 include shoulders 530 which extend throug and are resiliently held outwardly against openings 531. The ends 532 of the pins 529 can be squeezed inwardly by hand to clear the shoulders 530 from the openings 531 to separate the shelves 527 from the remainder of the irrigator 508. The ends 532 of the pins 529 are normally protected within recesses 533 as illustrated in FIGS. 19 and 20. When the shelves 527 are separated from the remainder of the irrigator 508, the irrigator 508 can be grasped between inner surfaces 534 of the recesses 533 as illustrated in FIG. 21.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A liquid dispensing attachment for a suction hose of a suction or vacuum cleaner comprising:

a suction nozzle having an inlet for intake of materials to be suctioned from a surface, the nozzle having an outlet away from the nozzle inlet, a fitting to which the nozzle outlet communicates and the fitting being connectable to a suction inlet of a suction cleaner for drawing a vacuum in the suction nozzle for generating suction at the nozzle inlet;

a dispensable liquid holding tank; means supporting the tank to the suction nozzle for forming a combined assembly of the suction nozzle and the tank;

dispensing means communicating with the tank for dispensing liquid from the tank during operation of the dispensing attachment with the nozzle inlet at a surface to be suctioned; the dispensing means comprising a dispensing valve communicating into the tank, and means, which in response to the placement of the nozzle inlet at a surface for suctioning material from the surface, opens the valve for dispensing liquid through the valve from the tank;

the dispensing means further comprising a dispenser connected with the dispensing valve, located externally of the tank and placed for dispensing the liquid in the vicinity of the nozzle inlet, whereby the attachment may be moved to move the nozzle inlet to the liquid for suctioning the liquid from the surface.

2. The attachment of claim 1, wherein the suction inlet is relatively narrower in a front to back direction with respect to movement of the attachment and is relatively much wider in the side to side direction;

the dispenser for dispensing liquid to the surface comprises a dispensing bar connected with the valve for receiving liquid from the valve, and the dispensing bar extending widthwise a substantial distance along the longer width dimension of the nozzle; the dispensing bar having a plurality of outlets distributed along the dispensing bar and placed for dispensing liquid near the nozzle inlet and along substantially the width of the nozzle inlet.

3. The attachment of claim 2, wherein the dispensing bar is located near to but outside the nozzle.

4. The attachment of claim 1, wherein the valve is normally closed against dispensing of liquid from the tank; the valve opening means comprising surface engaging means connected with the valve and positioned for engaging the surface when the nozzle inlet is moved to the surface; pressing the surface engaging means against the surface moves the surface engaging means and, through the connection of the surface engaging means with the valve, moves the valve from a nondispensing condition to a dispensing condition wherein the valve enables dispensing of liquid from the tank to the dispenser.

5. The attachment of claim 4, wherein the surface engaging means comprises an element which engages the surface, and the connection between the element and the valve comprises a bar joining the element with the valve, the valve being movable from the non-dispensing condition to the dispensing condition by movement of the bar due to movement of the surface engaging element; biasing means normally biasing the valve to the non-dispensing condition, and the bar extending from the surface engaging element overcoming the biasing force of the biasing means.

6. The attachment of claim 5, further comprising a strut pivotally connected with the nozzle and extending to the surface engaging element, the strut being pivotable with respect to the nozzle and the surface engaging element thereby pivoting along with the strut with respect to the nozzle.

7. The attachment of claim 6, further comprising a shoe on the bar, and the shoe engaging the valve for moving the valve to the dispensing condition as the surface engaging element moves with the pivoting of the strut.

8. The attachment of claim 4, wherein the valve comprises a valve element including a passageway leading to the dispenser, and an entrance opening of the valve element into the passageway and located in the tank, the entrance opening is movable as the valve element is moved in the tank; fixed means in the tank, a cooperating opening in the fixed means, the cooperating opening being placed for being aligned with the entrance opening to define a pathway from the tank; the cooperating opening being positioned so that when the surface engaging element is out of contact with the surface, the valve element is moved so that the passageway entrance opening and the tank cooperating opening are misaligned, and when the surface engaging element engages the surface and moves the valve element, the passageway entrance opening is gradually moved into alignment with the tank cooperating opening, enabling dispensing of liquid from the tank through the valve and the passageway.

9. The attachment of claim 8, wherein the valve element is reciprocable between the positions where the passageway entrance and the cooperating openings are aligned for enabling dispensing and are misaligned for blocking dispensing.

10. The attachment of claim 1, wherein the dispensing valve for liquid from the tank comprises:

a valve housing with a passage through it having an inlet communicating into the tank and an outlet communicating to the dispenser; a float valve element in the valve housing, and communicating with the passage inlet such that liquid entering the passage inlet floats the float valve element to a position blocking the passage inlet, preventing dispensing of liquid through the valve passage to the dispenser;

the responsive means comprising a conduit communicating to the valve housing at the side of the float valve element away from the passage inlet, such that suction drawn on the conduit moves the float valve element to a condition unblocking the communication between the passage inlet and the dispenser; the conduit communicating with the suction nozzle such that vacuum in the nozzle communicates through the conduit to operate the float valve element to the unblocking condition, and the float valve being adapted to respond to vacuum in the conduit at a high enough level that occurs when the nozzle inlet has been at least partially occluded.

11. The attachment of claim 10, wherein the float valve comprises a first valve element inlet chamber communicating with the passage inlet, a second valve element outlet chamber communicating with the passage outlet, a respective first and second ones of the float valve elements in each of the inlet and outlet chambers of the float valve, and a cross passage communicating between the inlet and the outlet chambers of the float valve; liquid in the chambers of the float valve causing the respective float elements therein to rise above the cross passage between the chambers for blocking passage of liquid between the chambers; the vacuum carrying conduit communicating to both the inlet chamber and the outlet chamber and applying a suction force thereto sufficient to pull the float elements down in the suction chambers past the cross passage, opening the communication from the inlet through the cross passage to the outlet from the float valve housing.

12. The attachment of claim 11, wherein the conduit communicates with the nozzle at a height high enough with respect to the tank that liquid in the conduit and in the float valve housing chambers will not be sucked through the conduit into the nozzle.

13. The attachment of claim 10, wherein the conduit communicates with the nozzle at a height high enough with respect to the tank that liquid in the conduit and in the float valve housing chambers will not be sucked through the conduit into the nozzle.

14. The attachment of claim 1, further comprising locking means slidable with respect to said tank between a first position for locking said valve in a closed position and a second, unlocked position for permitting said valve to open.

15. The attachment of claim 14, further comprising means for connecting said attachment to the suction inlet of the suction cleaner, said connecting means including a first bracket and a second bracket; and wherein said tank includes a recessed region; said locking means being located between said brackets and within said recessed region; and said locking means being adapted to surround the suction inlet of the suction cleaner.

16. The attachment of claim 14, further comprising means for indicating the position of said locking means.

17. The attachment of claim 1, wherein said dispensing means includes a flexible tube communicating with said tank; and wherein said valve includes means for closing said valve by pinching said tube.

18. The attachment of claim 17, wherein said dispenser includes an irrigator, said irrigator including a top communicating with said tube and a bottom for dispensing the liquid, said irrigator being movably mounted to said suction nozzle; said dispensing means includes biasing means for biasing said top of said irrigator toward said tube to pinch said tube; said irrigator being so placed that upon the nozzle inlet being placed at a surface to be suctioned, said irrigator is moved against the bias of said biasing means to release the pinching of said tube.

19. The attachment of claim 18, wherein said irrigator is placed so that said biasing means biases said bottom of said irrigator away from said suction nozzle.

20. The attachment of claim 19, wherein said irrigator is pivotally mounted to said suction nozzle.

21. The attachment of claim 19, further comprising said shelves being separable as a unit from said irrigator.

22. The attachment of claim 18, further comprising locking means for selectively locking said valve in a closed position and preventing said irrigator from moving against the bias of said biasing means.

23. The attachment of claim 22, further comprising said locking means being slidable with respect to said tank between a first position for locking said valve in a closed position and a second, unlocked position for permitting said valve to open.

24. The attachment of claim 18, wherein said irrigator includes shelves therein, and said irrigator includes openings at said bottom; said valve being adapted to allow the liquid to fall by gravity from said tank onto said irrigator, said shelves being shaped and disposed to allow the liquid to cascade over said shelves in a progressively wider pattern across said irrigator, and to allow the liquid to flow through said openings by gravity.

25. The attachment of claim 1, wherein said dispensing means includes an irrigator, said irrigator includes shelves therein, and said irrigator includes openings at said bottom; said valve being adapted to allow the liquid to fall by gravity from said tank onto said irrigator, said shelves being shaped and disposed to allow the liquid to cascade over said shelves in a progressively wider pattern across said irrigator, and to allow the liquid to flow through said openings by gravity.

* * * * *